US008418879B2

(12) United States Patent
Sherman et al.

(10) Patent No.: US 8,418,879 B2
(45) Date of Patent: Apr. 16, 2013

(54) POP-UP BATH TISSUE PRODUCT

(75) Inventors: Crystal Espinoza Sherman, Menasha, WI (US); Benjamin C. Sarbo, Winneconne, WI (US); Heather Anne Sorebo, Appleton, WI (US); Daniel Hoo, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1437 days.

(21) Appl. No.: 11/216,531

(22) Filed: Aug. 31, 2005

(65) Prior Publication Data

US 2007/0045334 A1 Mar. 1, 2007

(51) Int. Cl.
*B65G 59/00* (2006.01)
*B65H 3/00* (2006.01)
*G07F 11/00* (2006.01)

(52) U.S. Cl.
USPC ..... 221/34; 221/48; 221/63; 221/33; 221/54; 221/38; 221/130; 221/47; 221/45

(58) Field of Classification Search ..... 221/33, 221/48, 49, 34, 63, 54, 38, 130, 47, 45
See application file for complete search history.

(56) References Cited

U.S. PATENT DOCUMENTS

| | | | | |
|---|---|---|---|---|
| 2,119,360 A | | 5/1938 | Schleicher | |
| 2,502,772 A | * | 4/1950 | Winstead | 156/163 |
| 2,604,254 A | | 7/1952 | Rosenfield | |
| 2,781,902 A | | 2/1957 | Smithers | |
| 2,902,187 A | * | 9/1959 | Cabanban | 221/240 |
| 3,012,692 A | * | 12/1961 | Petersen | 221/63 |
| 3,585,104 A | | 6/1971 | Kleinert | |
| 3,700,138 A | * | 10/1972 | Nelson | 221/51 |
| 3,837,595 A | * | 9/1974 | Boone | 242/594.5 |
| 4,017,002 A | * | 4/1977 | Doyle et al. | 221/63 |
| 4,106,616 A | * | 8/1978 | Boone | 206/233 |
| 4,106,617 A | * | 8/1978 | Boone | 206/233 |
| 4,195,787 A | * | 4/1980 | Thomason | 40/360 |
| 4,201,331 A | | 5/1980 | Austin | |

(Continued)

FOREIGN PATENT DOCUMENTS

| | | |
|---|---|---|
| EP | 0366514 A1 | 5/1990 |
| GB | 2361800 A | 10/2001 |
| WO | WO 0207129 A1 | 1/2002 |
| WO | WO 0232670 A1 | 4/2002 |

OTHER PUBLICATIONS

PCT Search Report and Written Opinion PCT/US2006/021478.
Shannon et al., U.S. Appl. No. 11/220,378, filed Aug. 31, 2005, Rolled Bath Tissue Product for Children.

*Primary Examiner* — Gene O. Crawford
*Assistant Examiner* — Rakesh Kumar
(74) *Attorney, Agent, or Firm* — Dority & Manning, P.A.

(57) ABSTRACT

Various pop-up bath tissue dispensing devices are described. In one embodiment, the bath tissue dispenser is configured to dispense bath tissues one at a time. In order to educate a child during toilet training on how much tissue to use, the tissue sheets contained within the dispenser have a size sufficient such that only one sheet is necessary for wiping. The dispenser can include an attachment device for attaching the dispenser to a spindle while still permitting the spindle to hold a conventional roll of bath tissue. In various embodiments, the tissue sheets or the dispenser may include designs or other indicia to either encourage a child during toilet training or to help educate the child during toilet training.

5 Claims, 10 Drawing Sheets

U.S. PATENT DOCUMENTS 4,205,802 A * 6/1980 Economakis ..... 242/594.5
4,238,541 A 12/1980 Burton
4,457,964 A * 7/1984 Kaminstein ..... 428/43
4,469,243 A * 9/1984 Ito et al. ..... 221/34
4,478,354 A * 10/1984 Notheis ..... 221/34
4,594,130 A 6/1986 Chang et al.
D297,596 S * 9/1988 Marquart, Sr. ..... D5/62
4,793,898 A 12/1988 Laamanen et al.
4,798,312 A * 1/1989 Scheiber ..... 222/180
4,834,316 A * 5/1989 DeLorean ..... 242/594.5
4,913,312 A 4/1990 Boutin
4,928,849 A * 5/1990 Khozai ..... 221/45
4,978,095 A * 12/1990 Phillips ..... 248/312
5,007,558 A * 4/1991 Allen et al. ..... 221/48
5,041,317 A * 8/1991 Greyvenstein ..... 428/35.5
5,076,424 A * 12/1991 Nakamura ..... 206/205
5,123,343 A 6/1992 Willer
5,167,346 A 12/1992 Bodziak
5,205,454 A * 4/1993 Schutz et al. ..... 225/1
5,242,057 A * 9/1993 Cook et al. ..... 206/581
5,311,986 A * 5/1994 Putz ..... 206/233
5,332,118 A * 7/1994 Muckenfuhs ..... 221/48
5,409,181 A * 4/1995 Patrick ..... 242/596.2
5,562,964 A * 10/1996 Jones ..... 428/43
5,595,628 A 1/1997 Gordon et al.
5,609,269 A 3/1997 Behnke et al.
5,618,008 A * 4/1997 Dearwester et al. ..... 242/594.5
5,644,897 A * 7/1997 Young et al. ..... 53/438
5,678,727 A * 10/1997 Rice ..... 221/98
5,753,331 A * 5/1998 Jeffrey ..... 428/43
5,802,974 A 9/1998 McNeil
5,820,730 A 10/1998 Phan et al.
5,891,008 A * 4/1999 Bavely et al. ..... 493/405
5,897,074 A * 4/1999 Marino ..... 242/594.1
5,957,325 A * 9/1999 Montanez ..... 221/131
D417,351 S * 12/1999 Scavuzzo ..... D6/515
6,047,920 A * 4/2000 Dearwester et al. ..... 242/594.5
D425,346 S 5/2000 Thompson
6,165,319 A 12/2000 Heath et al.
6,257,410 B1 7/2001 Ulmann et al.
6,265,052 B1 7/2001 Steinhardt et al.
6,299,729 B1 10/2001 Heath et al.
6,318,555 B1 11/2001 Kuske et al.
6,382,552 B1 * 5/2002 Paul et al. ..... 242/595
6,398,910 B1 6/2002 Burazin et al.
6,427,839 B1 * 8/2002 Helfer-Grand ..... 206/494
6,439,386 B1 * 8/2002 Sauer et al. ..... 206/494
6,460,727 B1 * 10/2002 Irwin ..... 221/63
6,585,130 B2 * 7/2003 Turbett et al. ..... 221/45
6,592,068 B2 * 7/2003 Taylor et al. ..... 242/596.8
6,800,357 B2 10/2004 Keberlein
6,848,595 B2 * 2/2005 Lange et al. ..... 221/48
6,910,600 B2 6/2005 Keberlein
6,926,308 B2 8/2005 Penn et al.
6,945,493 B1 * 9/2005 Gottesman ..... 242/594.5
7,059,493 B2 * 6/2006 Welchel et al. ..... 221/34
7,090,106 B2 * 8/2006 Holden ..... 225/106
7,494,027 B2 * 2/2009 O'Leary et al. ..... 221/34
2001/0025856 A1 * 10/2001 Lefevre Du Grosriez et al. ..... 221/33
2002/0079322 A1 * 6/2002 Wilkes et al. ..... 221/34
2003/0054326 A1 * 3/2003 Aaron-Barrada ..... 434/236
2003/0070955 A1 * 4/2003 Kuske et al. ..... 206/494
2003/0102098 A1 6/2003 Allen et al.
2003/0152896 A1 * 8/2003 Hudson ..... 434/258
2004/0003521 A1 * 1/2004 Penn et al. ..... 40/299.01
2004/0099679 A1 * 5/2004 Welchel et al. ..... 221/34
2004/0115394 A1 * 6/2004 Lange et al. ..... 428/126
2004/0124203 A1 7/2004 Phelps et al.
2004/0178210 A1 9/2004 McDonald
2004/0245266 A1 * 12/2004 Mitchell et al. ..... 221/33
2004/0245267 A1 12/2004 Mitchell et al.
2004/0251590 A1 12/2004 Mitchell et al.
2004/0258886 A1 12/2004 Maciag
2004/0258887 A1 12/2004 Maciag et al.
2004/0261639 A1 12/2004 Vaughn et al.
2005/0000976 A1 1/2005 Keberlein
2005/0067125 A1 3/2005 Burazin et al.
2005/0215146 A1 9/2005 Shannon

* cited by examiner

POP-UP BATH TISSUE PRODUCT

BACKGROUND OF THE INVENTION

One of the many challenges that exist during the training of a child to use a toilet is teaching the child to use an appropriate amount of bath tissue. In situations where a child uses more bath tissue than actually needed, not only is there waste of the excess bath tissue, but also the excess bath tissue can create a mess within the bathroom, potentially even clogging the toilet or related plumbing. Furthermore, any mess or clogs resulting from the use of excess bath tissue could frustrate the child and discourage his or her progress in the training.

The difficulties with children learning to use the appropriate length of bath tissue can be associated with the difficulty that children can have in determining both an appropriate amount and the sheet count of the bath tissue. For example, the child may not intuitively know what amount of bath tissue is appropriate to use without a visual cue or other pattern on the bath tissue.

To help the child during the training process, a parent or other teacher may instruct the child to use a certain amount of bath tissue. Typically, a parent would instruct or suggest an amount of bath tissue to use, measured by the sheet count of the bath tissue. For example, a parent may instruct the child to use 3 or 4 sheets. Young children, however, have difficulty in not only counting to 3 or 4, but also have difficulty in seeing the perforations that separate the individual sheets, especially with the added pressure of the toilet training process.

In addition, a child in the toilet training process may have difficulty in separating the toilet tissue from the rolled product in a neat manner, such as on the perforations. The child may not be able to see or feel the perforations between the sheets. Even if the child can find the perforations, the child may also have difficulty cleanly tearing on the perforation depending on the characteristics of the product.

Many previous rolled tissue products have incorporated designs or pictures on the base web. These designs are typically directed to making the tissue product more aesthetically pleasing to a child, or even to an adult. Some designs may even be directed to a side benefit of helping to teach a child the alphabet or numbers. However, the previous rolled tissue products may not be successful in teaching the child an appropriate amount of bath tissue to use.

As such, a need exists for a bath tissue product that can assist a child in determining the appropriate amount of bath tissue to be used, especially during the toilet training process.

SUMMARY OF THE INVENTION

In general, the present disclosure is directed to a bath tissue product that is particularly well suited for use by young children during toilet training and after. For example, the teachings of the present disclosure may be used to assist a child in recognizing the proper amount of toilet tissue to use. In this manner, the child will not use an excessive amount of toilet tissue that may clog the toilet, make a mess in the bathroom, or be wasteful.

For example, in one embodiment, the present disclosure is directed to a bath tissue product that comprises a dispenser defining an opening. A plurality of tissue sheets may be stacked together within the dispenser. The tissue sheets may be arranged in the dispenser so as to be dispensed one at a time from the dispenser opening. Each of the tissue sheets have a length sufficient such that only one sheet is needed during a wiping operation. For example, the sheets may have a length of from about 10 inches to about 30 inches, such as from about 12 inches to about 25 inches. By dispensing tissue sheets one at a time having a desired length, the bath tissue product meters usage and avoids waste. If desired, the product may be used to teach children the proper amount of toilet tissue needed when using the toilet.

To further assist children during toilet training when making a transition from the above described bath tissue product to a rolled product, the individual tissue sheets may also be perforated to more assimilate a rolled product. In fact, the plurality of tissue sheets may be connected together along a perforation line if desired. In other embodiments, however, the sheets may be unattached but interfolded.

In one embodiment, the individual sheets can also be prefolded prior to be placed in the dispenser. When dispensed from the dispenser, the sheets can remain in their prefolded state so that they are ready to use without the user having to fold or bunch the tissue sheets together. For example, in one embodiment, each of the tissue sheets may be bunched at each end prior to being placed in the dispenser.

If desired, various designs may be incorporated onto the tissue sheets, such as by being printed on the sheets. For example, the tissue sheets may include alphanumeric characters, animated scenes, cartoon characters, or ornamental figures. In fact, in one embodiment, the tissue sheets themselves may have a non-rectangular, ornamental shape. The ornamental shape may match a design element on the dispenser. The tissue sheets may also include various instructional indicia for educating a user regarding an aspect of toilet training.

Likewise, the outside surface of the dispenser may also include various teaching and training tools. For instance, the outside surface of the dispenser may illustrate a game, a picture intended to be colored by a user, or may also include instructional indicia for assisting in toilet training a child. In one embodiment, the outside surface of the dispenser may display a reward chart on which a child may apply stickers or otherwise decorate.

The dispenser may include an attachment device for attaching the dispenser to an adjacent structure. For example, the attachment device may comprise a pair of arms that each include a connection device for coupling the dispenser to a fixture in the bathroom. In one embodiment, for instance, the attachment device may be configured to attach the dispenser to a spindle for holding a roll of bath tissue. The arms may have a length that allows a full roll of toilet tissue to also be placed on the spindle so that the bath tissue product of the present disclosure can be used in conjunction with conventional bath tissue rolls.

In another embodiment, the dispenser may include a first opening and a second opening. A first plurality of tissue sheets may be configured to be dispensed out of the first opening, while a second plurality of tissue sheets may be configured to be dispensed out of the second opening. The second plurality of tissue sheets may have at least one characteristic that is different than the first plurality of tissue sheets. For instance, the first plurality of tissue sheets may have a length longer than the second plurality of tissue sheets. In this manner, the longer tissue sheets may be used to wipe after bowel movements, while the second plurality of tissue sheets may be used to wipe after urination alone.

In addition to having a dispenser containing two different openings and two different size tissue sheets, alternatively, the bath tissue product may include a first dispenser that is connected to a second dispenser. The first dispenser may be used to dispense a first tissue sheet, while the second dispenser may be used to dispense a second tissue sheet.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
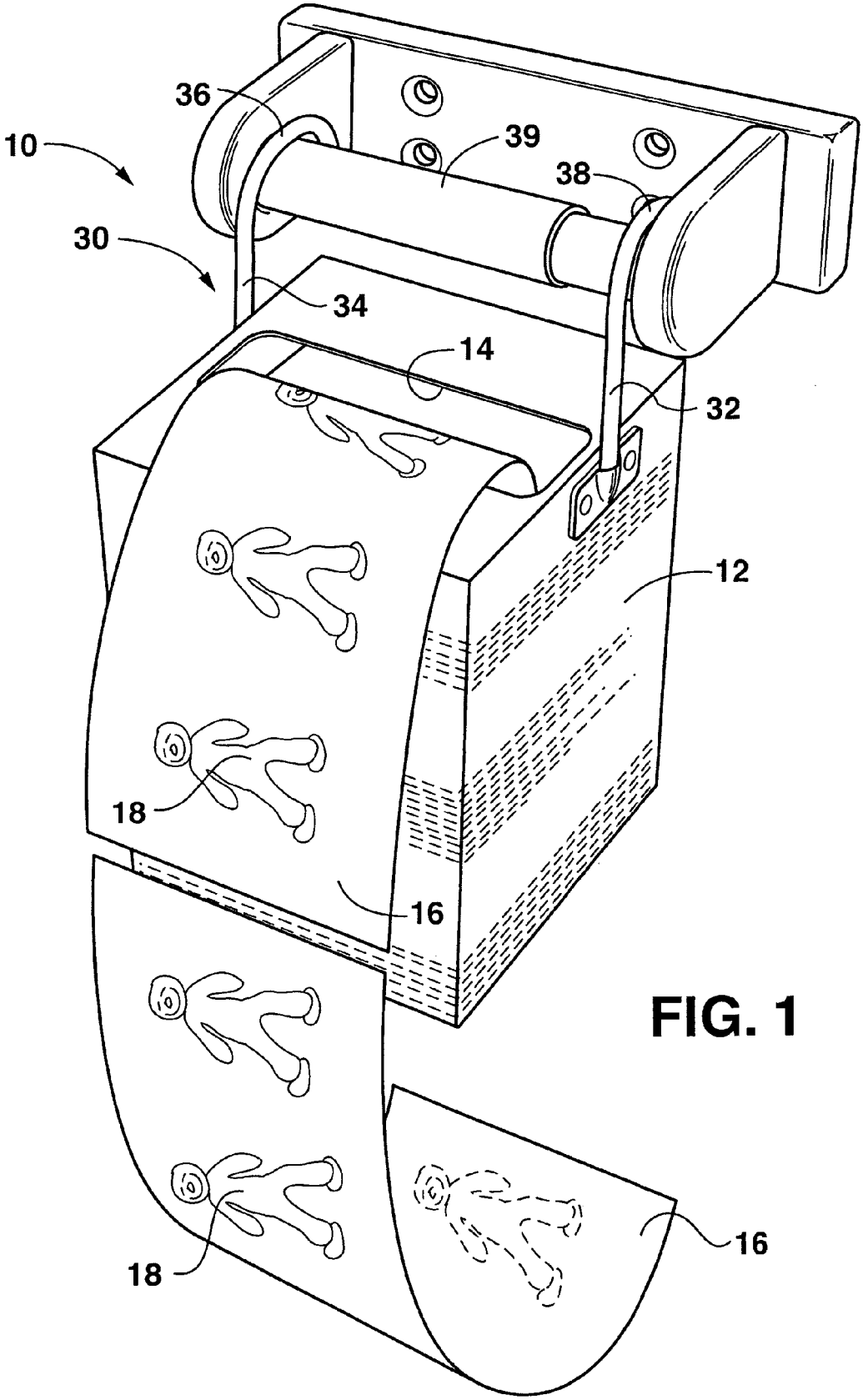
FIG. 1 is a perspective view of one embodiment of a bath tissue product made according to the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a bath tissue product in which a bath tissue is dispensed from a dispenser one sheet at a time. The sheets may be contained in the dispenser in a stacked arrangement and may be unattached together and interfolded or may be attached together along a line of perforations.

The bath tissue product is particularly well suited to assisting children during toilet training and after. For example, parents are known to complain that children have a tendency to use too much toilet paper which is not only wasteful but may also cause the toilet to clog. In order to assist children in determining the appropriate amount of bath tissue to use, in one embodiment, the bath tissue sheets contained in the bath tissue product have a length sufficient so that only one sheet is necessary during any wiping operation. The bath tissue product may dispense the tissue sheets one at a time, which meters usage and avoids children using too much bath tissue. Conventional rolled tissue products, for example, include relatively short squares separated by lines of perforations. Children can have a difficult time determining how many of the sheet squares are needed. The tissue sheets contained in the bath tissue product of the present disclosure, however, may be dispensed in an appropriate length that, after repeated use, will teach a child how much bath tissue is needed during wiping.

In various embodiments, the bath tissue product of the present disclosure may also include kid-friendly graphics and product geometry that encourage children during the toilet training process. For instance, a pattern or design may be located on at least one side of the tissue sheets. The pattern can extend over the length of the tissue sheets for further reinforcing to a child an appropriate amount of bath tissue that should be used during toilet training and after.

The pattern or design applied to the bath tissue can also be aesthetically appealing to help calm and encourage the child during toilet training. For example, the tissue sheets may display characters that are easily recognizable by a child, such as cartoon-like characters. Additionally, alphanumeric characters, such as numbers and/or letters may be applied to the tissue sheet to help supplement the child's development and learning processes. For example, the tissue sheets may contain a pattern comprising consecutive alphanumeric characters that can help the child learn the alphabet or how to count. In still other embodiments, instructional indicia may be applied to the tissue sheets for educating the child regarding an aspect of toilet training.

The bath tissue product of the present disclosure may also include an attachment device for attaching the product to an adjacent surface, such as to any suitable fixture located in a bathroom. In one embodiment, for instance, the attachment device may be configured to attach to a bathroom spindle designed to hold conventional rolls of bath tissue. Of particular advantage, in one embodiment, the pop-up bath tissue product may be suspended from a spindle while still allowing the spindle to hold a conventional roll of bath tissue. Thus, the bath tissue product may be co-located with a conventional roll of tissue without taking up spindle space.

Referring to FIG. 1, one embodiment of a bath tissue product generally 10 is illustrated. As shown, the bath tissue product 10 includes a dispenser 12 defining an opening 14. The dispenser 12 may be made from any suitable material. For example, the dispenser 12 may be made from paperboard that is typically used to construct facial tissue dispensers. In alternative embodiments, however, the dispenser 12 may also be made from a molded plastic or from a flexible plastic film.

Contained within the dispenser 12 is a stack of tissue sheets 16. The tissue sheets 16, for example, may be contained within the dispenser in an interfolded relationship and may be positioned so as to be dispensed from the dispenser 12 through the opening 14. In one embodiment, for instance, the bath tissue sheets may be interfolded such that when the leading sheet 16 is dispensed from the dispenser 12, a preceding sheet is partially withdrawn through the opening 14.

As described above, in one embodiment, each of the tissue sheets 16 may have a length that is sufficient so that only a single sheet is needed during wiping. For exemplary purpose, for example, in one embodiment the tissue sheets may have a length of from about 10 inches to about 30 inches, such as from about 12 inches to about 25 inches. Tissue sheets contained on a conventional rolled tissue product typically have a length of from about 3.5 inches to about 4.5 inches. During wiping, from about 2 sheets to about 5 sheets are desirably used, such as from about 3 sheets to about 4 sheets. In this manner, the tissue sheet 16 as shown in FIG. 1 may have a length that generally corresponds between about 2 sheets to about 5 sheets on conventional rolled products.

The width of the tissue sheet 16 is generally not critical. The width, for example, may be the same width as a conventional rolled product. The width, for example, may be from about 3 inches to about 6 inches. Of course, the tissue sheet may have a width less than 3 inches or greater than 6 inches.

The bath tissue product 10 can thus be designed to issue tissue sheets one at a time having an appropriate length for wiping. In this manner, the product may be used to not only meter usage of the tissue sheets but may also be used as a training tool for children who are toilet training. By using the product, children become familiar with the amount of toilet paper needed to wipe.

In some embodiments, the tissue sheet 16 as shown in FIG. 1 may be configured to more closely simulate conventional rolled bath tissue. For example, in one embodiment, each of the individual sheets 16 may include perforation lines that divide the individual sheets into squares having dimensions similar to the squares contained on conventional rolls. Including the perforations may assist a child in making the transition from the bath tissue product 10 as shown in FIG. 1 to a rolled tissue product.

Alternatively instead of including perforation lines, the bath tissue sheet 16 may include lines that are printed on the sheets. Printing lines, such as dotted lines on the bath tissue sheet may be less expensive than perforating the tissue sheets while still providing a training tool to a child.

Figure 8:
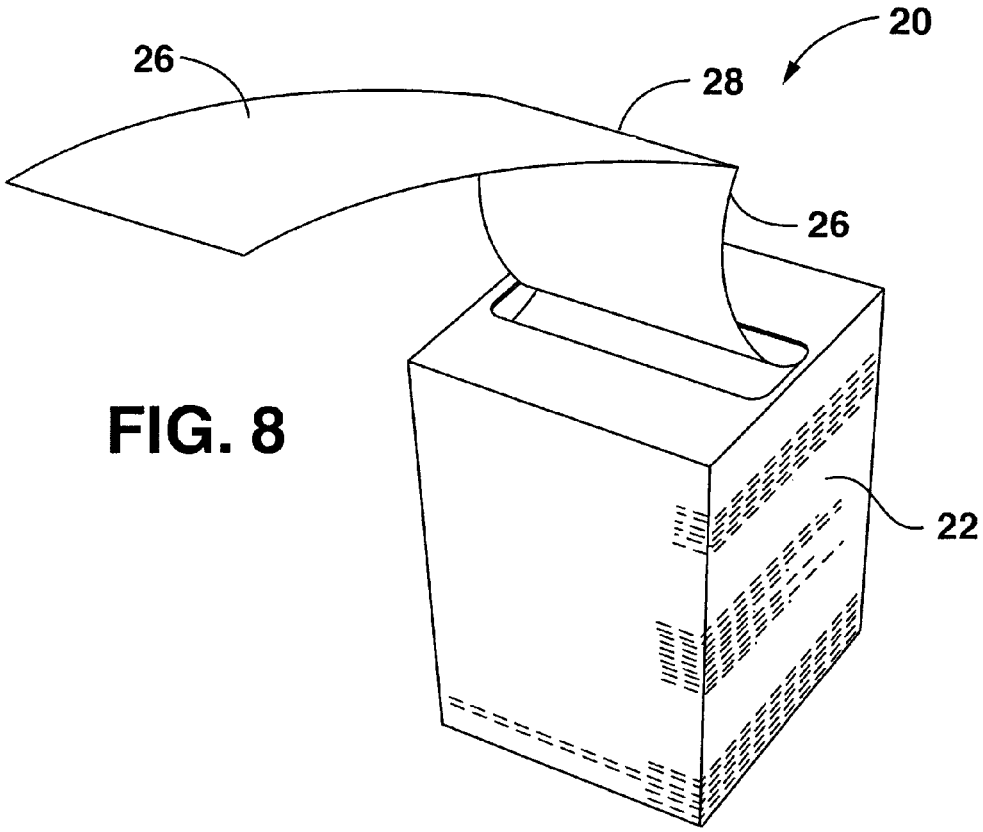
FIG. 8 is a perspective view of another embodiment of a bath tissue product made in accordance with the present invention.

In the embodiment illustrated in FIG. 1, the bath tissue sheets 16 are unattached. In other embodiments, however, as shown in FIG. 8, the bath tissue sheets may be attached together when stacked in the dispenser. For instance, referring to FIG. 8, a bath tissue product 20 is shown that includes a dispenser 22 containing bath tissue sheets 26. In this embodiment, the bath tissue sheets 26 are connected together along a line of perforations 28. The bath tissue sheets 26 may be connected along a line of perforations in order to further assimilate a conventional rolled product. In particular, in this embodiment, a child will need to separate the tissue sheets 26 using the perforations 28 similar to using a rolled product.

Figure 9:
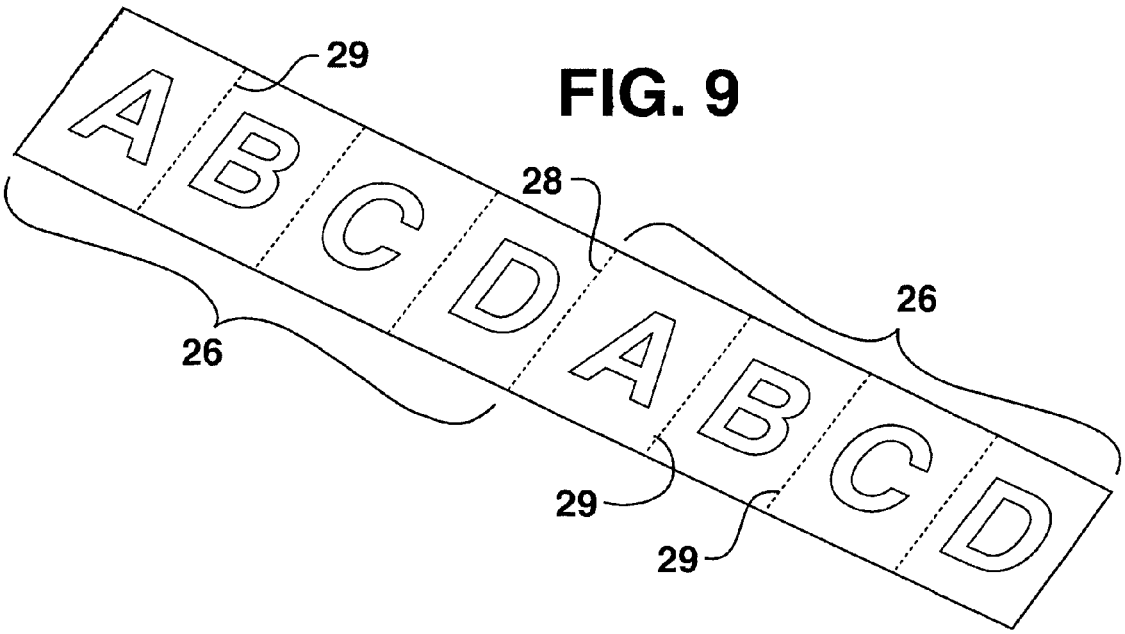
FIG. 9 is a perspective view of one embodiment of a bath tissue that may be contained in a dispenser according to the present disclosure.

In the embodiment illustrated in FIG. 8, in addition to containing the lines of perforations 28, each of the tissue sheets 26 may include further lines of perforations in order to, again, simulate a rolled product. For example, as shown in FIG. 9, each tissue sheet 26 may include further lines of perforations 29 that divide the tissue sheets 26 into conventional sized squares contained on tissue rolls. In this embodiment, the lines of perforations 28 and 29 may vary in strength. For example, the line of perforations 28 may be much weaker than the lines of perforations 29. In this manner, when the tissue sheet 26 is pulled, the sheet separates at the perforation line 28, instead of the perforation lines 29. Thus, the perforation lines 29 are merely included for educational purposes. In fact, the lines 29, instead of perforations, can simply be printed onto the sheets.

As shown in FIGS. 1 and 9, the individual tissue sheets may include various design elements. For example, the tissue sheets may include alphanumeric designations, animated scenes, cartoon characters, ornamental figures, and the like. In FIG. 1, for example, the tissue sheets 16 include a cartoon character 18 that may make the product more appealing to children. The cartoon characters 18 may repeat as shown in FIG. 1, may differ within the individual sheets or may differ from sheet to sheet.

In the embodiment illustrated in FIG. 9, a pattern of alphanumeric characters have been applied to the tissue sheets 26. In this embodiment, for instance, the pattern is comprised of four consecutive letters. Each group of letters may extend over any predetermined distance, such as the distance of one of the tissue sheets 26.

In the embodiment shown in FIG. 9, each group of alphanumeric characters signifies and further reinforces the appropriate amount of the bath tissue sheet that should be used during wiping. For example, a child can be taught or instructed that the appropriate amount of bath tissue to use is the distance that each group extends, which corresponds with the length of each of the tissue sheets 26. The child can be taught to tear the product between the different groups. Also, when alphanumeric characters are present in the pattern, the bath tissue product may further serve to teach letters to a child and/or to assist the child in counting numbers.

Referring back to FIG. 1, the bath tissue product 10 further includes an attachment device generally 30. In this embodiment, for example, the attachment device 30 includes a pair of opposing arms 32 and 34 that are each connected to the dispenser 12. Each arm is integral with a connecting device 36 and 38 that is configured to attach the bath tissue product 10 to an adjacent structure, such as a spindle 39. In one embodiment, the arms 32 and 34 may have a length sufficient so that the spindle 39 may also accommodate a conventional rolled bath tissue product in addition to the bath tissue product 10.

The connecting devices 36 and 38 may comprise any suitable device capable of attaching to an adjacent structure. In the embodiment illustrated in FIG. 1, for instance, the connecting devices 36 and 38 comprise hooks. Alternatively, the connecting devices 36 and 38 may comprise loops through which the spindle 39 may be threaded.

Figure 2:
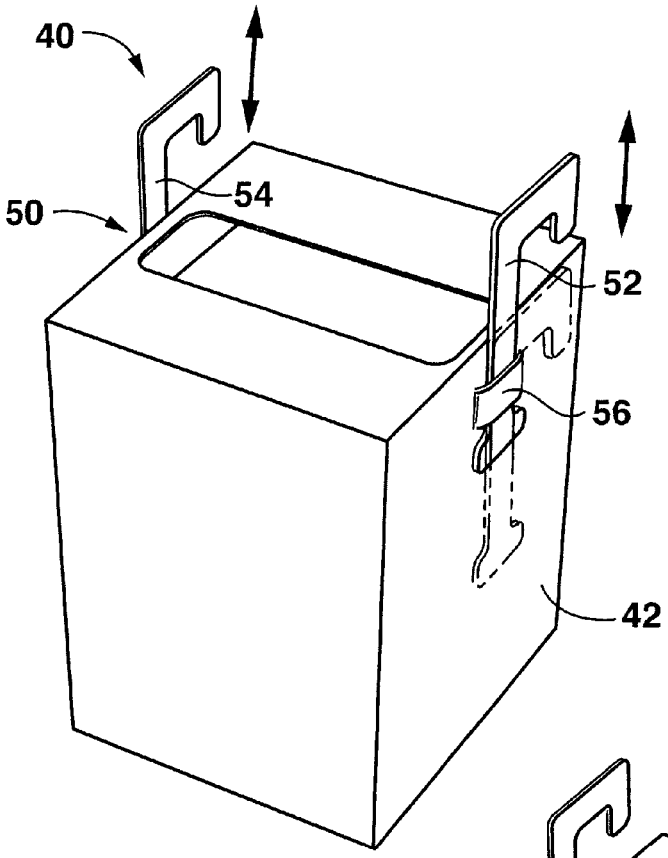
FIG. 2 is a perspective view of an alternative embodiment of a bath tissue product made in accordance with the present disclosure.

Referring to FIG. 2, another embodiment of a bath tissue product 40 is illustrated. The bath tissue product 40 as shown in FIG. 2 is similar to the bath tissue product 10 as shown in FIG. 1. The bath tissue product 40 includes a dispenser 42 for dispensing bath tissue sheets. An attachment device generally 50 is included for attaching the bath tissue product 40 to an adjacent structure. The attachment device 50 includes a pair of opposing arms 52 and 54. In this embodiment, however, the arms 52 and 54 are retractable such that the arms remain out of the way during packaging and if they are not needed during use. For example, as shown, the arm 52 is slideably mounted within a pocket 56. In the embodiment illustrated in FIG. 2, the arms are mounted on an outside surface of the dispenser 42. It should be understood, however, that in other embodiments the arms may be mounted on an inside surface of the dispenser.

In still another embodiment of the present invention as shown in FIG. 2, the attachment device 50 may be integral with the dispenser 42 and may be defined, for instance, by various lines of perforations. In this manner, the arms are masked when the dispenser is positioned for dispensing from a horizontal surface, such as a counter or a floor. The arms may be readily releasable by breaking the perforation lines to permit the housing to be releasably coupled to a fixture in a bathroom. Such an arrangement, for instance, is disclosed in U.S. Patent Application Publication No. US 2004/0245266 filed on May 16, 2003 and which is incorporated herein by reference.

Figure 4A:
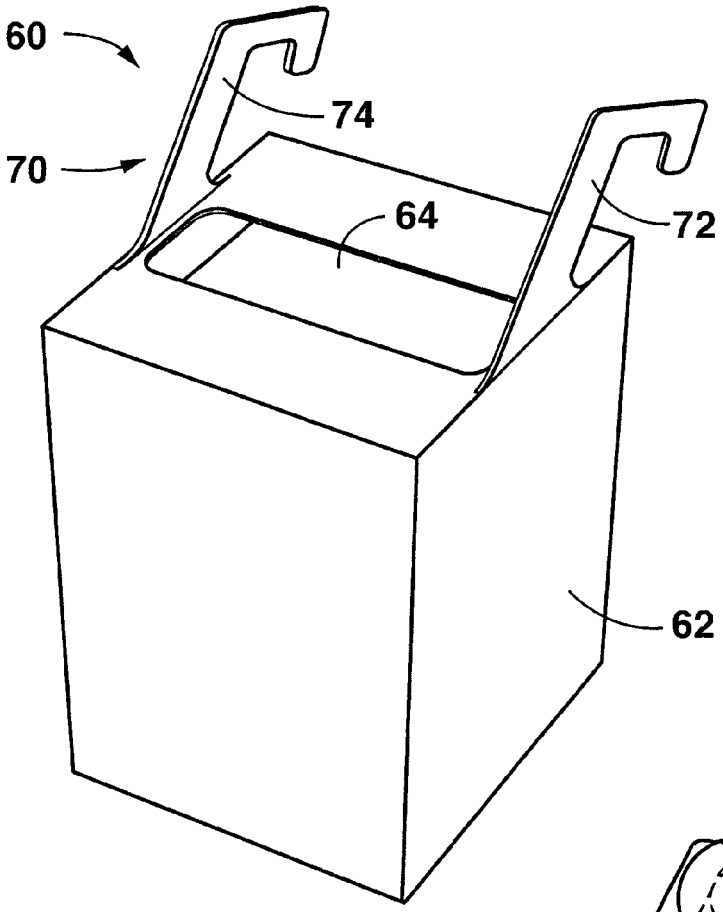
FIG. 4A is a perspective view of another embodiment of a bath tissue product made in accordance with the present disclosure.
Figure 4B:
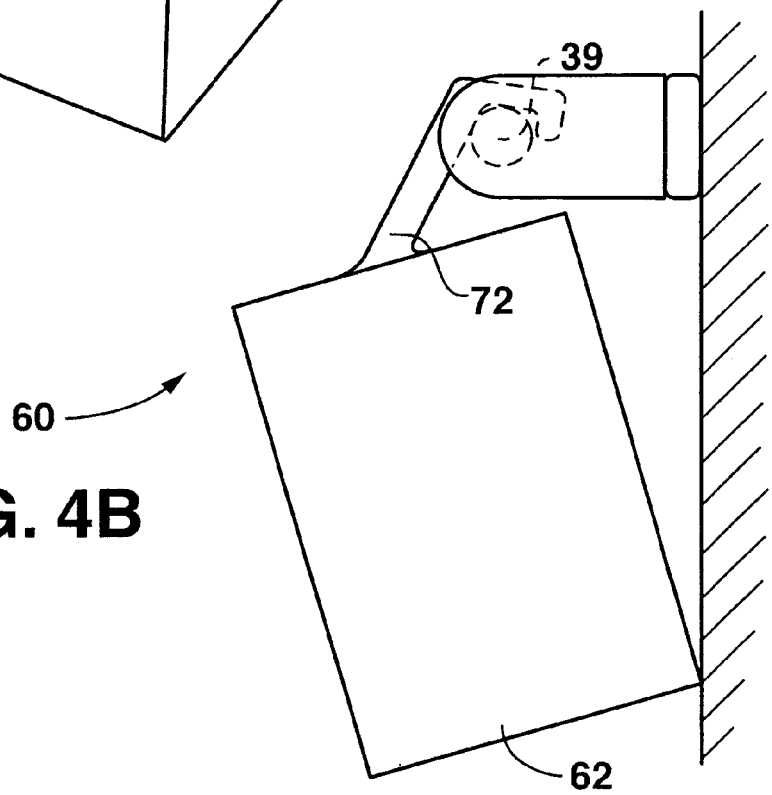
FIG. 4B is a side view of the embodiment illustrated in FIG. 4A.

Referring to FIGS. 4A and 4B, still another embodiment of a bath tissue product generally 60 is shown including a dispenser 62 containing a plurality of stacked tissue sheets. In this embodiment, the bath tissue product 60 includes an attachment device 70. The attachment device 70 comprises a pair of arms 72 and 74 that extend from a top surface of the dispenser 62 at an angle. More particularly, the arms 72 and 74 form an acute angle with a top surface of the dispenser 62.

In this manner, as shown in FIG. 4A, the attachment device 70 is configured to angle the top of the dispenser 62 towards a user when engaging an adjacent structure, such as the spindle 39. Thus, an opening 64 in the dispenser 62 is more readily accessible by a user especially if the spindle 39 also holds a roll of toilet tissue.

In addition to the embodiments described above, the attachment device may include any other suitable device capable of attaching the dispenser to an adjacent surface. For example, in an alternative embodiment, the attachment device may comprise a pressure sensitive adhesive applied to the dispenser. In still another embodiment, the attachment device may comprise a hook and loop fastener, such as VELCRO. When using hook and loop fasteners, the hooks or the loops may be applied and adhered to the dispenser.

In addition to the use of hook and loop fasteners, the attachment device in other embodiments may comprise any suitable clip, clamp, and the like.

In some embodiments, it may be desirable to have a bath tissue product capable of dispensing different bath tissue sheets that differ by at least one characteristic. The characteristic may vary depending upon the particular application. For instance, the dispenser may contain single ply tissue sheets and multi-ply tissue sheets. Alternatively, the bath tissue dispenser may contain a dry tissue product and a premoistened tissue product. In still another embodiment, the tissue dispenser may include tissue sheets that differ in length. A longer tissue sheet may be used, for instance, for wiping during bowel movements, while a shorter sheet may be used for wiping after urination.

In addition to the above, various other characteristics may differ between the two tissue sheets. For example, one tissue sheet may be treated with a lotion while the other may be untreated. Additionally, both tissue sheets may be treated with different chemistries. Other characteristics that may differ between the sheets include embossing designs, printing designs, tissue sheet shapes, color, basis weight, strength, rolled product versus folded product, fiber furnish, and the like.

Figure 5:
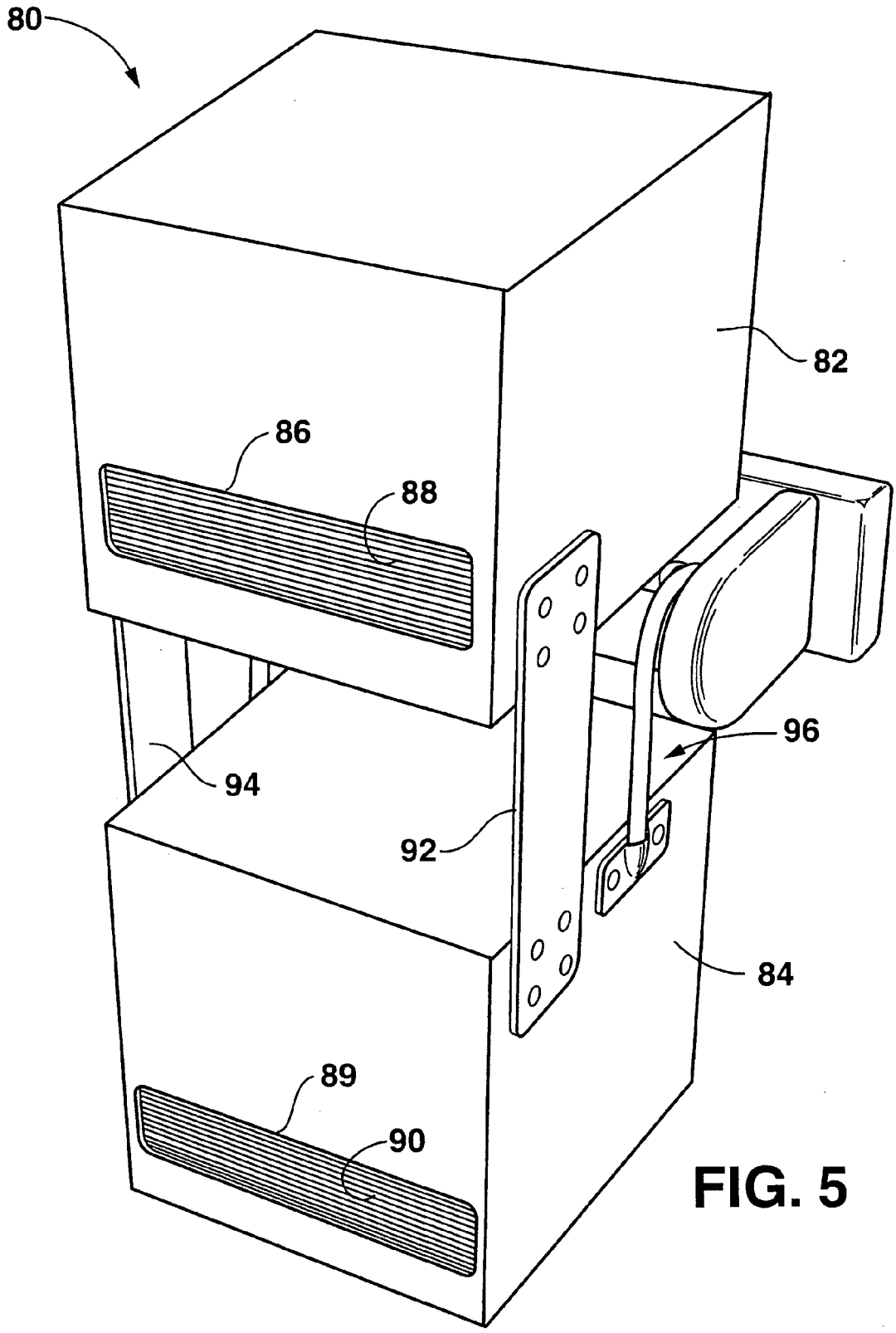
FIG. 5 is a perspective view of still another embodiment of a bath tissue product made in accordance with the present invention.

Referring to FIG. 5, one embodiment of a bath tissue product generally 80 that may contain two different types of bath tissue sheets is illustrated. As shown, the bath tissue product 80 includes a first dispenser 82 connected to and spaced from a second dispenser 84. The first dispenser 82 defines an opening 86 for dispensing a first plurality of tissue sheets 88. Likewise, the second dispenser 84 defines an opening 89 for dispensing a second plurality of tissue sheets 90. As described above, the first stack of tissue sheets 88 may differ in at least one characteristic from the second stack of tissue sheets 90. For example, in one particular embodiment, the tissue sheets 88 may have a length longer than the tissue sheets 90. Both stacks of tissue sheets may comprise a dry product or may comprise a premoistened product.

As shown in FIG. 5, the openings 86 and 89 are located on a side panel of each of the respective dispensers. It should be understood, however, that the openings may be located in other locations. For instance, both openings may be located on the top of each dispenser or on the bottom of each dispenser. Further, one dispenser may include an opening on the side, while the other dispenser may include an opening on the top or bottom. In still another embodiment, one dispenser may include an opening on the top, while the other dispenser may include an opening on the bottom.

As illustrated, the first dispenser 82 is connected to the second dispenser 84 via a pair of panels 92 and 94. The bath tissue product 80 further includes an attachment device 96 for attaching the product to, for instance, a spindle as shown.

In the embodiment illustrated in FIG. 5, the attachment device 96 is positioned in between the first dispenser 82 and the second dispenser 84. It should be understood, however, that in other embodiments both dispensers may be positioned either above or below the spindle. In one embodiment, the panels 92 and 94 may have a length sufficient to separate the first dispenser 82 from the second dispenser 84 such that a roll of bath tissue may still reside on the spindle and be dispensed even in the presence of the bath tissue product 80.

Figure 6:
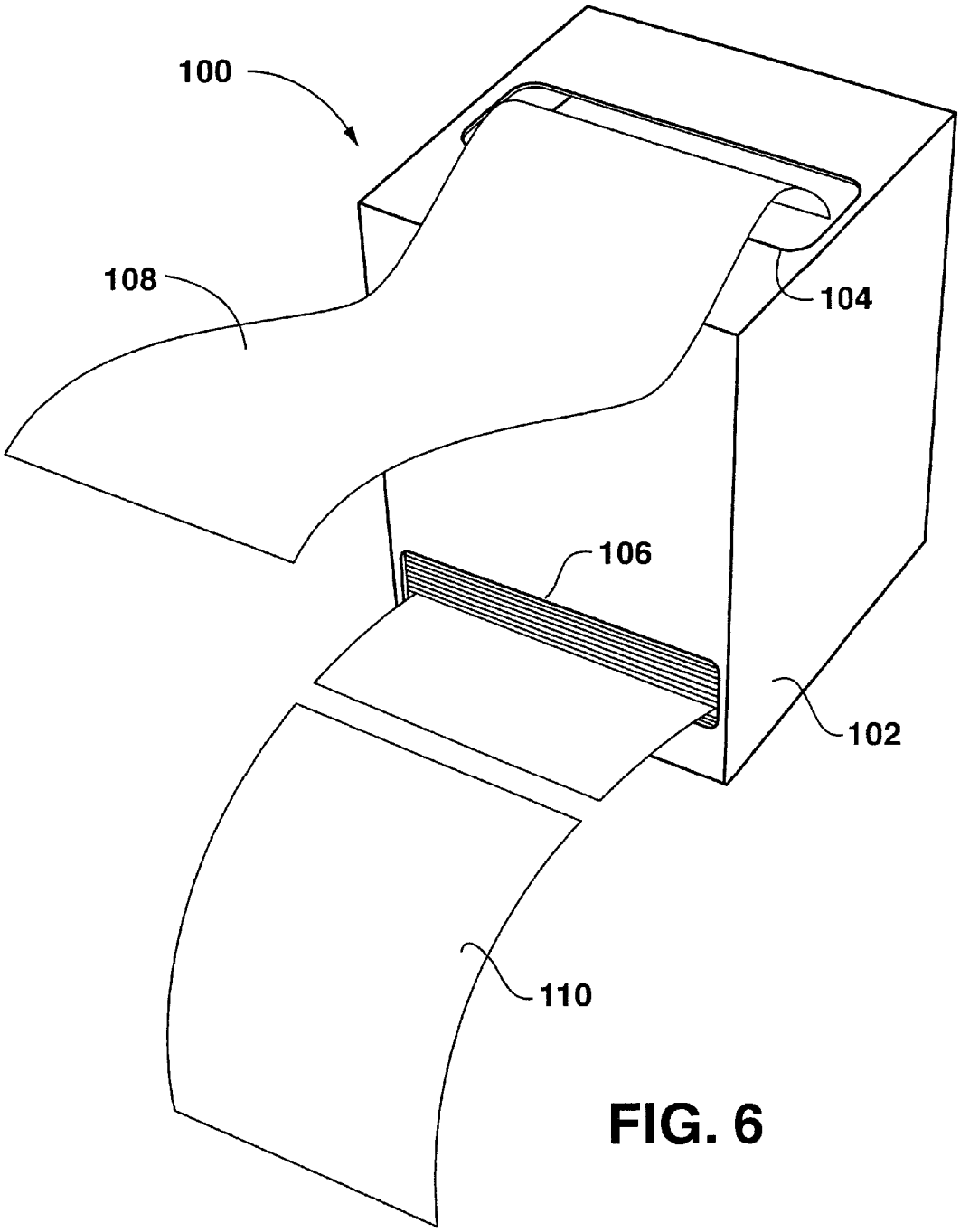
FIG. 6 is a perspective view of another embodiment of a bath tissue product made in accordance with the present disclosure.

Referring to FIG. 6, still another embodiment of a bath tissue product generally 100 is shown. In this embodiment, the bath tissue product 100 includes a single dispenser 102 that defines a first opening 104 and a second opening 106. A first plurality of tissue sheets 108 are contained in the dispenser 102 and positioned to be dispensed through the first opening 104. In this embodiment, the dispenser 102 further includes a second plurality of tissue sheets 110 that are positioned to be dispensed through the second opening 106. As described above, the tissue sheets 108 may have at least one characteristic that is different from the tissue sheets 110. As shown in FIG. 6, for instance, the tissue sheets 108 have a length longer than the tissue sheets 110.

In the embodiment shown in FIG. 6, the first opening 104 is on the top surface while the second opening 106 is on a side surface of the dispenser 102. It should be understood, however, that the openings may be located in different locations on the dispenser as desired.

Figure 7:
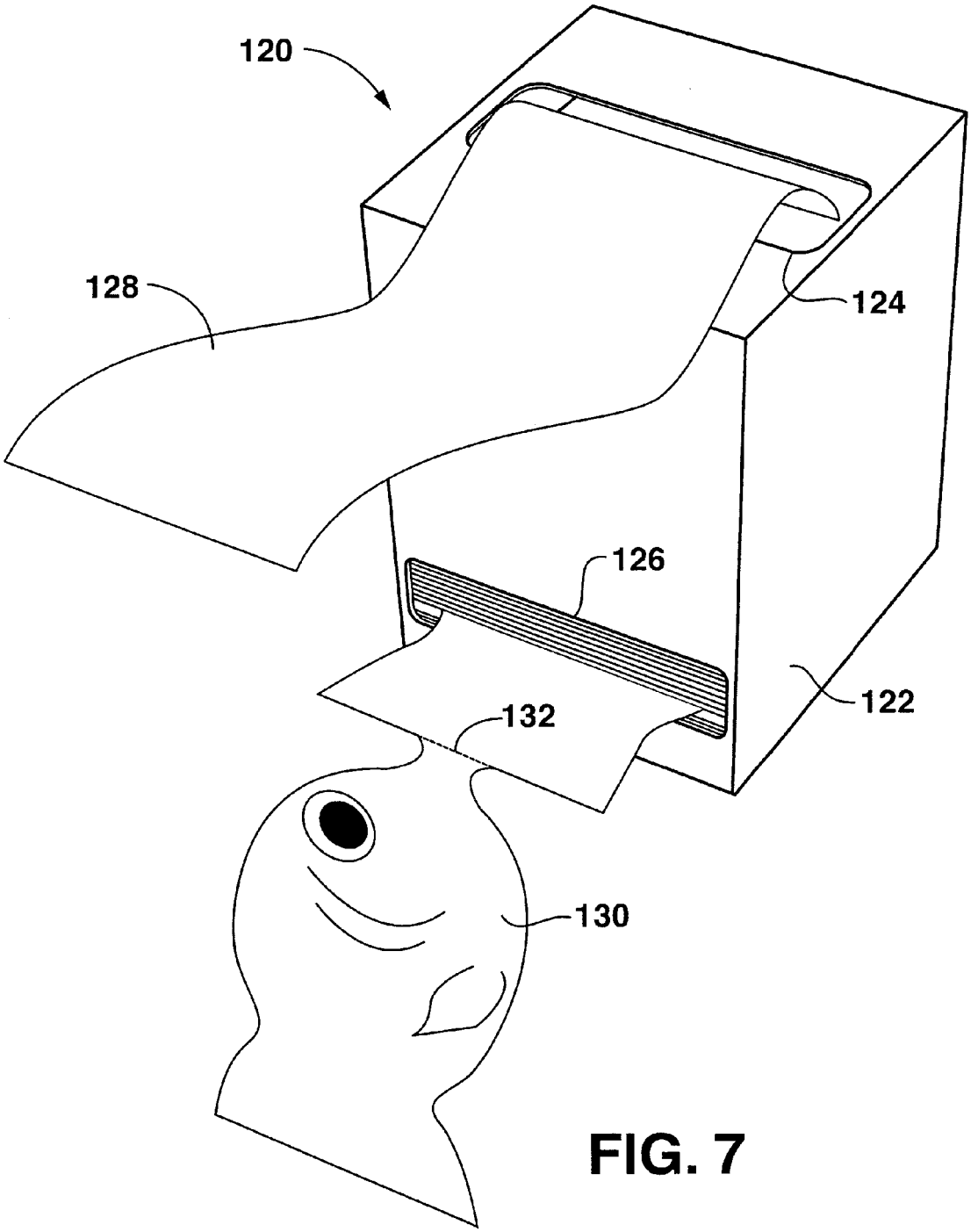
FIG. 7 is a perspective view of yet another embodiment of a bath tissue product made in accordance with the present disclosure.

Referring to FIG. 7, still another embodiment of a bath tissue product generally 120 is illustrated. The bath tissue product 120 as shown in FIG. 7 is similar to the bath tissue product as shown in FIG. 6. Specifically, the bath tissue product 120 includes a single dispenser 122 defining a first opening 124 for dispensing a first plurality of tissue sheets 128 and a second opening 126 for dispensing a second plurality of tissue sheets 130. In this embodiment, the tissue sheets 130 have a non-rectangular, ornamental shape. In particular, the tissue sheets 130 are in the shape of a fish. As shown, each of the shapes are connected together across a line of perforations 132.

It should be understood that in any of the embodiments illustrated in the figures, the tissue sheets may have an ornamental shape as shown in FIG. 7. Such shapes may assist in amusing children and further encouraging them during toilet training. Ornamentally-shaped tissue sheets may also have a shape that is better suited to fit the shape/size of a child's hand. Further, in addition to fish-like shapes, it should be understood that the tissue sheets 130 may have any suitable ornamental shape as desired.

Figure 3:
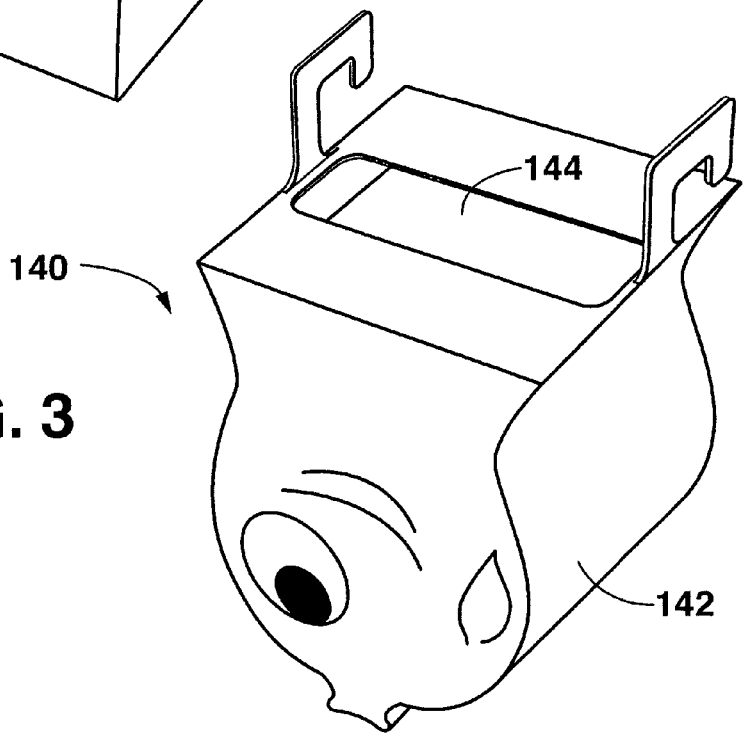
FIG. 3 is a perspective view of still another embodiment of a bath tissue product made in accordance with the present disclosure.

In addition to containing tissue sheets having a decorative shape, the dispenser itself may also have a non-cubicle shape. For example, referring to FIG. 3, a bathroom tissue product generally 140 is shown that includes an ornamental dispenser 142 having the shape of a fish. If desired, a plurality of stacked tissue sheets 144 may be contained within the dispenser 142 and may have a shape that matches or otherwise complements the shape of the dispenser 142.

Figure 13:
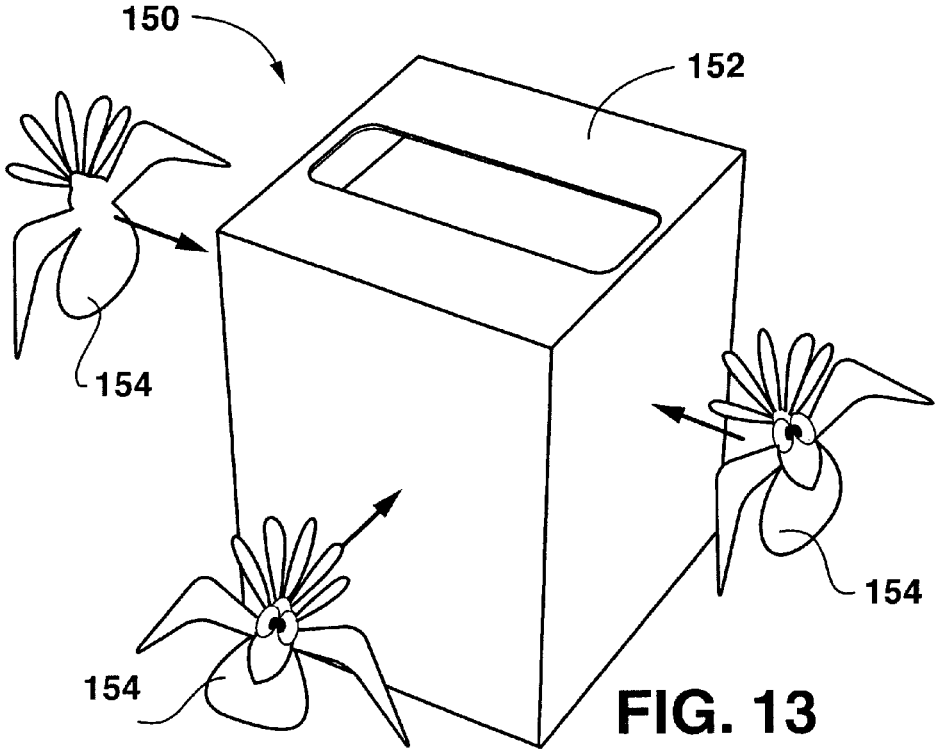
FIG. 13 is a perspective view of another embodiment of a bath tissue dispenser made in accordance with the present disclosure.

In addition to having an ornamental shape, the dispenser may include various aesthetic designs, games and the like to further amuse and encourage children during toilet training. For example, referring to FIG. 13, a bath tissue product generally 150 is shown that includes a dispenser 152 containing a plurality of tissue sheets stacked together. In this embodiment, the tissue product 150 is intended to be packaged with a plurality of stickers 154. The stickers can be unwrapped by a child, for instance, and applied to the box for decorations. In this manner, the child is allowed to personalize the dispenser 152 to further encourage the child to properly use the toilet. In one embodiment, the box may include some type of reward chart to which stickers may be applied. For example, a child may apply stickers to the reward chart based upon learning the bathroom basics of wiping, flushing, washing, drying, etc.

Figure 14:
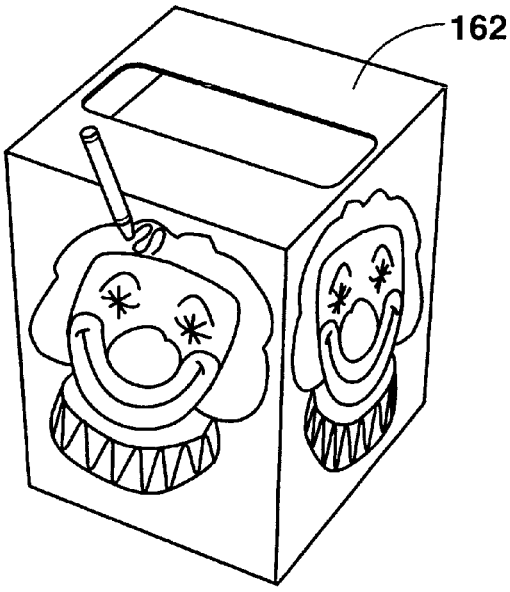
FIG. 14 is a perspective view of still another embodiment of a bath tissue dispenser made in accordance with the present disclosure.

In addition to stickers, the dispenser 152 may include various other features. For example, as shown in FIG. 14, a dispenser 162 is shown that includes various images intended to be colored. If desired, crayons or washable markers may be packaged with the tissue product for allowing a child to color the box prior to or during use.

Figure 15:
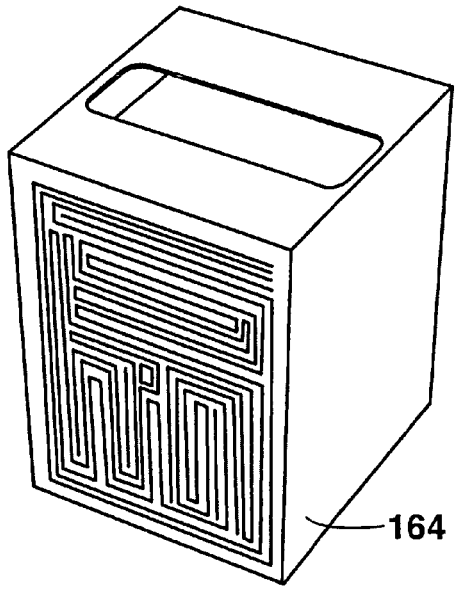
FIG. 15 is a perspective view of another embodiment of a bath tissue dispenser made in accordance with the present disclosure.

Referring to FIG. 15, another tissue dispenser 164 is illustrated. In this embodiment, the tissue dispenser 164 includes a game that a child may play. In FIG. 15, the game comprises a maze. It should be understood that various other games may be included on the dispenser 164. For example, other games that may be placed on the outside surface of the dispenser include tic-tac-toe, picture matching games, games that assist in identifying letters or numbers, and the like.

In still another aspect of the present disclosure, various designs contained on the bath tissue product dispenser may be matched or coordinated with other paper product dispensers. For example, referring to FIG. 12, a bath tissue product generally 170 is shown including a dispenser 172. The dispenser 172 is for dispensing individual tissue sheets through an opening 174. In this embodiment, a decorative cartoon character 176 appears on the outside of the dispenser 172.

If desired, the design appearing on the dispenser 172 may be matched with any other suitable paper product dispenser contained in the residence. For instance, in one embodiment, the design elements on the dispenser 172 may be matched with the design elements appearing on a dispenser 178 for dispensing premoistened wipes 180. As shown, both dispensers contain the same design element or cartoon character.

Figure 12:
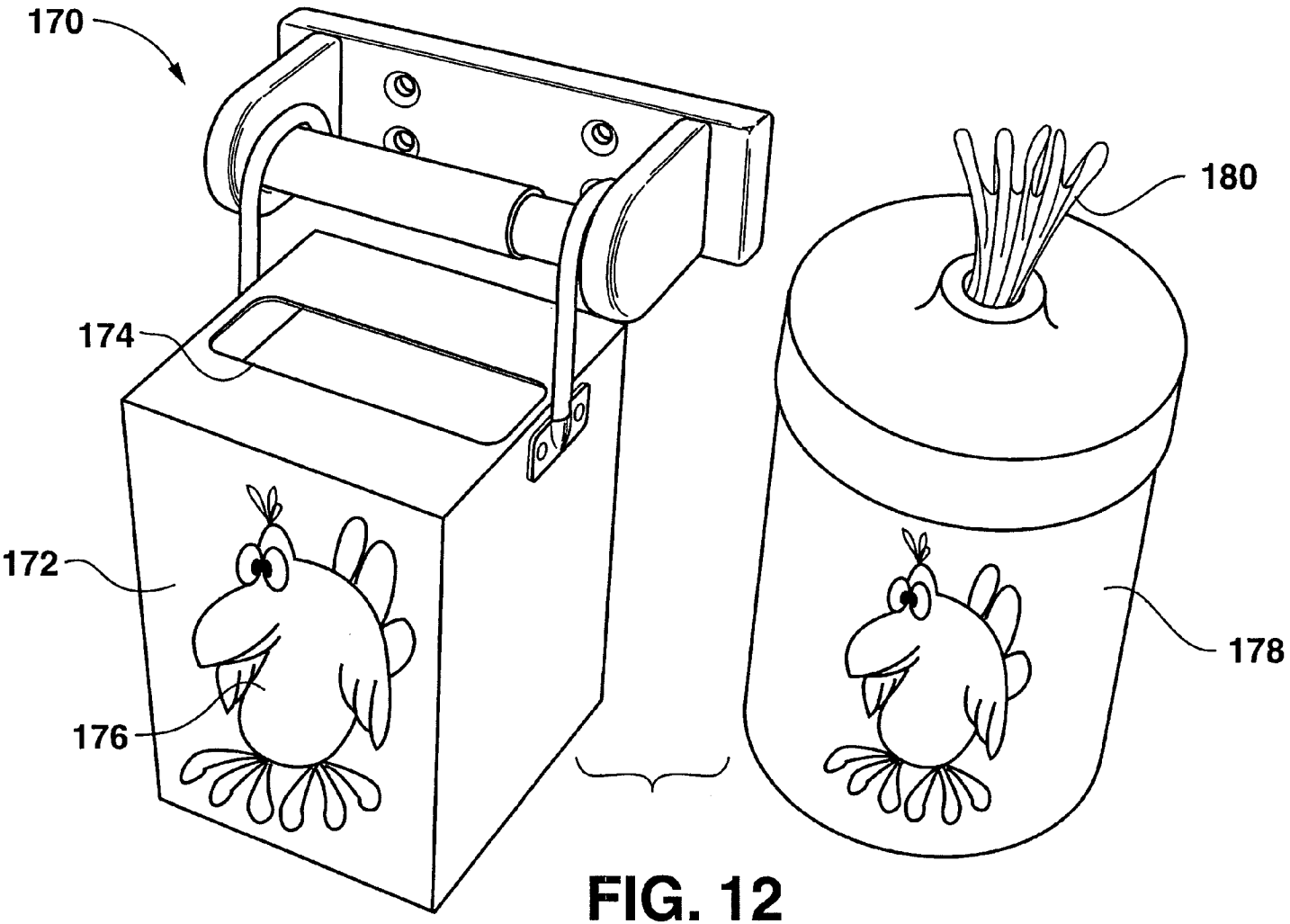
FIG. 12 is a perspective view of the bath tissue product illustrated in FIG. 1 in combination with a premoistened tissue dispenser in which both dispensers have matching design elements.

In addition to cartoon characters as shown in FIG. 12, it should be understood that any suitable design element may be matched or coordinated between the two dispensers. For instance, the design element may comprise a color, a graphic style, or a theme. Further, it should be understood that the tissue sheets contained within the bath tissue product 170 may also be embossed or printed with a design element that matches the outside surface of the dispenser 172.

Figure 10:
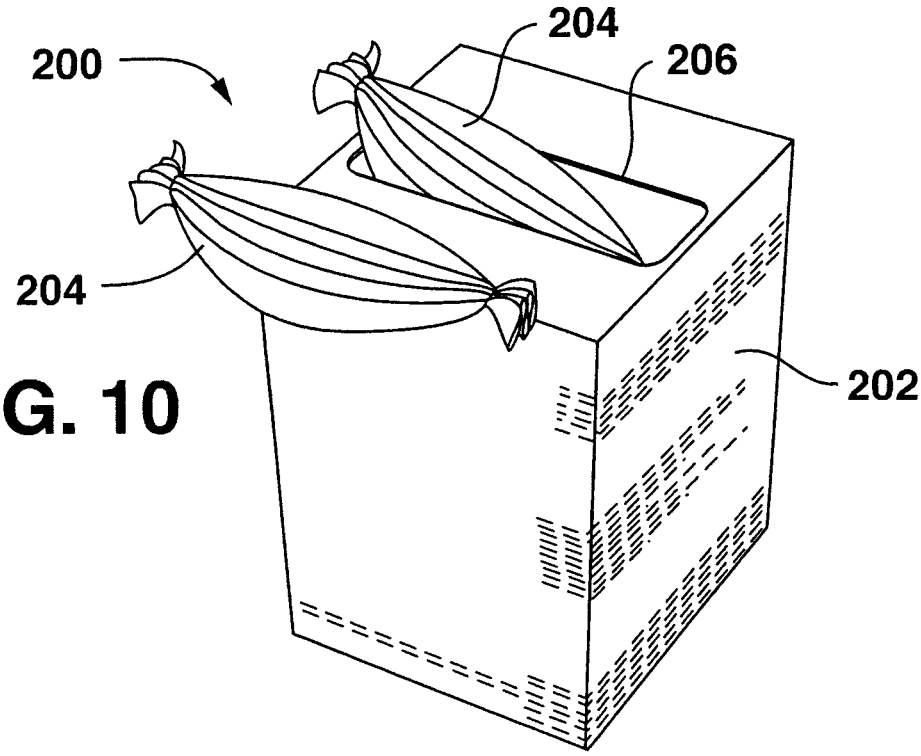
FIG. 10 is a perspective view of still another embodiment of a bath tissue product made in accordance with the present disclosure.

Referring to FIG. 10, still another embodiment of a bath tissue product generally 200 made in accordance with the present disclosure is shown. In this embodiment, the bath tissue product 200 includes a dispenser 202 containing a plurality of individual tissue sheets 204 that are dispensed through an opening 206. In this embodiment, the individual tissue sheets 204 are prefolded or otherwise bunched/gathered together to further assist a child during toilet training. In this manner, the tissue sheets emerge from the dispenser 202 in a condition ready for wiping. The child does not have to bunch together or otherwise fold the tissue sheets for use.

The tissue sheets 204 can be prefolded in any suitable manner such that they will retain their folded condition when dispensed from the dispenser 202. In the embodiment illustrated in FIG. 10, for instance, each end of the tissue sheet 204 has been bunched together in order to create a prefolded state. The ends of the tissue product may be bunched together using, for instance, crimping, an adhesive, or any other chemical or mechanical bond.

Figure 11:
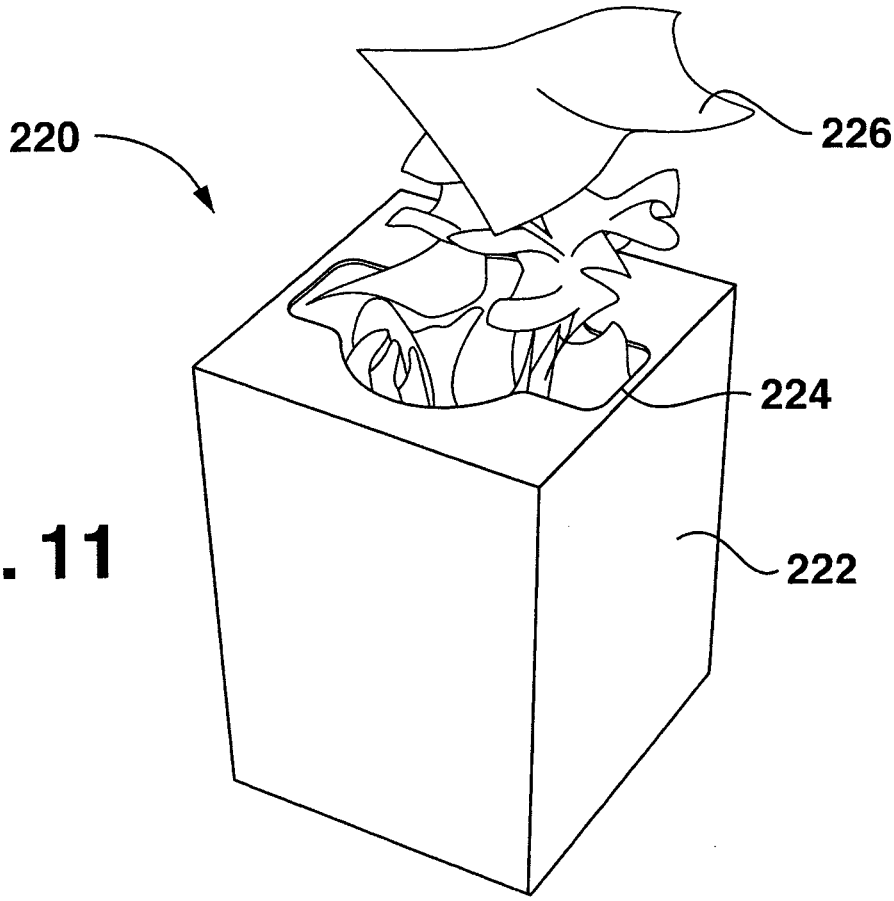
FIG. 11 is a perspective view of another embodiment of a bath tissue product made in accordance with the present disclosure.

Referring to FIG. 11, still another embodiment of a bath tissue product generally 220 made in accordance with the present disclosure is illustrated. In this embodiment, the tissue product 220 includes a dispenser 222 defining an opening 224 for dispensing individual tissue sheets 226. As shown, the tissue sheets 226 have a relatively small size. For example, the tissue sheets 226 may have a size similar to a single square on a conventional rolled tissue product. The tissue sheets 226 are contained within the dispenser 222 in a random arrangement. In this embodiment, a user inserts his hand into the opening 224 and pulls a handful of the tissue sheets 226 from the dispenser 222 for use. The tissue sheets 226 can have a size and can be packed within the dispenser 222 such that an optimum amount of the sheets are dispensed should a child's hand reach into the dispenser through the opening 224. As shown, the dispenser 224 can include a wide portion in order to accommodate the entire hand of a user.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A bath tissue product comprising:

a dispenser defining a first opening and a second opening;

a first plurality of dry tissue sheets positioned in the dispenser for being dispensed out of the first opening; and a second plurality of dry tissue sheets having at least one characteristic different than the first plurality of tissue sheets, the second plurality of tissue sheets being positioned within the dispenser for being dispensed out of the second opening and wherein the at least one characteristic comprises length such that the first tissue sheets have a longer length than the second tissue sheets.

2. A bath tissue product as defined in claim 1, wherein the first plurality of tissue sheets are unattached and contained in the dispenser in a stacked arrangement and the second plurality of tissue sheets are also unattached and contained in the dispenser in a stacked arrangement, the first plurality of tissue sheets having a length of at least 10 inches, while the second plurality of tissue sheets having a length of less than about 10 inches.

3. A bath tissue product as defined in claim 1, wherein the dispenser further comprises an attachment device for attaching the dispenser to an adjacent structure.

4. A bath tissue product as defined in claim 1, wherein the first plurality of tissue sheets have a non-rectangular, ornamental shape.

5. A bath tissue product as defined in claim 1, wherein the dispenser defines an outside surface, the outside surface illustrating a game, a picture intended to be colored by a user, a reward chart, or instructional indicia for educating a user regarding an aspect of toilet training.

* * * * *